United States Patent [19]

Esker

[11] 4,243,187

[45] Jan. 6, 1981

[54] MISSILE DIRECTOR WITH BEAM AXIS SHIFT CAPABILITY

[75] Inventor: Andrew T. Esker, St. Louis County, Mo.

[73] Assignee: McDonnell Douglas Corporation, St. Louis, Mo.

[21] Appl. No.: 901,501

[22] Filed: May 1, 1978

[51] Int. Cl.[2] ..... F41G 7/14

[52] U.S. Cl. ..... 244/3.13

[58] Field of Search ..... 244/3.13, 3.16

[56] References Cited

U.S. PATENT DOCUMENTS

| | | | |
|---|---|---|---|
| 3,501,113 | 3/1970 | Maclusky | 244/3.13 |
| 3,690,594 | 9/1972 | Menke | 244/3.13 |
| 4,014,482 | 3/1977 | Esker et al. | 244/3.13 |

*Primary Examiner*—Charles T. Jordan

*Attorney, Agent, or Firm*—Lionel L. Lucchesi

[57] ABSTRACT

A line of sight guidance system in which the radiated output of a pulsed laser is spatially modulated to produce a beam radiated from an optical projector along a first axis, including a missile or projectile carrying a beam receiver and signal decoder which receives and decodes information in the beam to enable the missile to seek beam center, is provided with apparatus for generating a lead angle axis reference for the missile. The basic technique comprises FM modulating the rotational rate of an orbitally driven projected beam chopping spoked reticle. The FM modulation amplitude is chosen to equal the magnitude of the desired angular change of the projected spatially coded axis, while the FM modulation phase is made to equal the direction in which the projected spatially coded axis is shifted. The receiver at the missile interprets the image of the reticle pattern as if the receiver where displaced from the unmodualted first axis position in a direction from beam center as indicated by the modulation phase. Since the missile is controlled to the beam axis center, it follows the coded axis shift.

15 Claims, 11 Drawing Figures

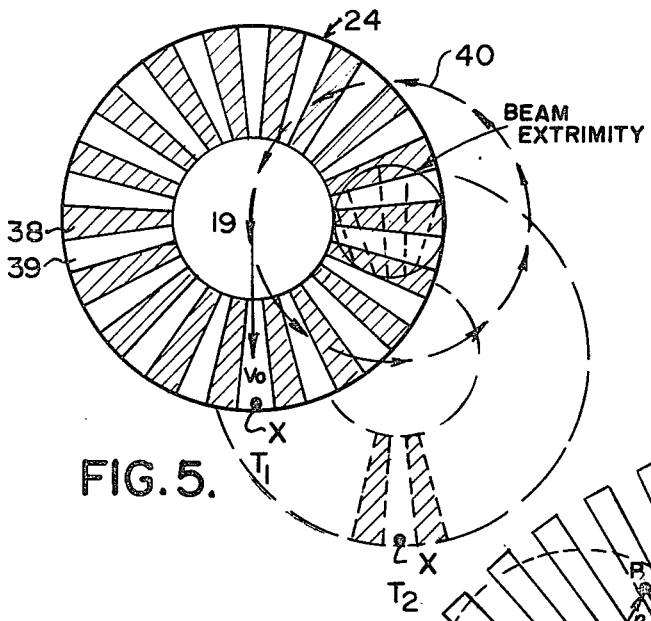
FIG. 5.
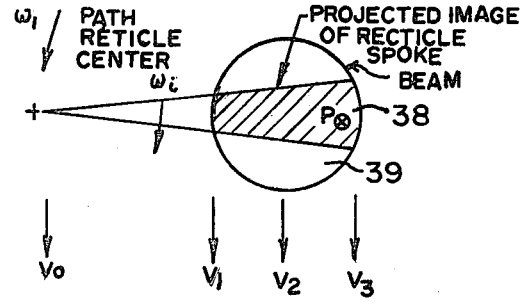
FIG. 6.
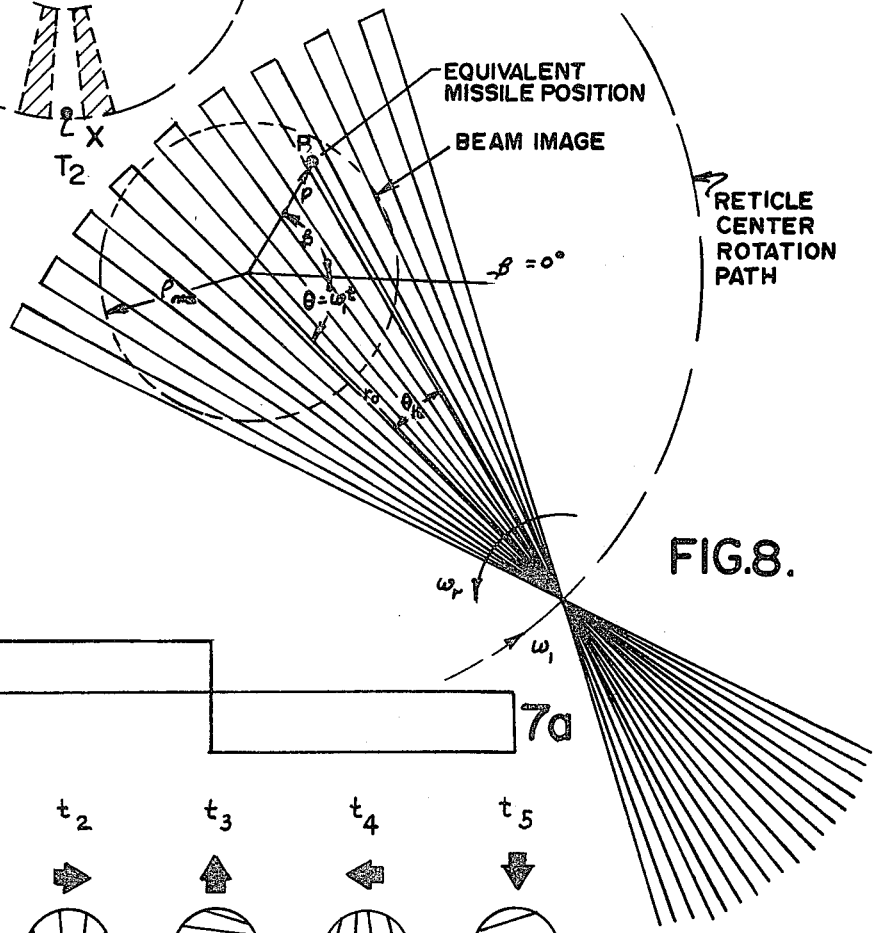
FIG. 8.
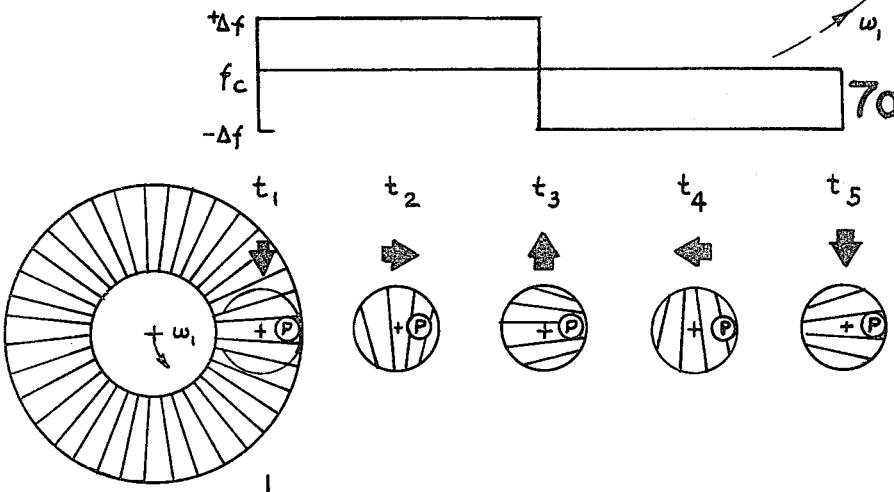
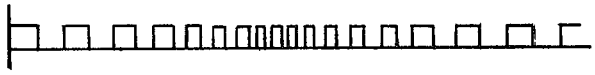
7c
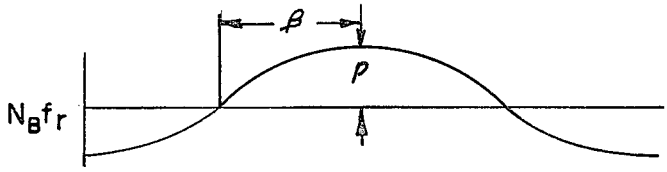
7d

MISSILE DIRECTOR WITH BEAM AXIS SHIFT CAPABILITY

BACKGROUND OF THE INVENTION

This invention relates to a line of sight guidance system, and in particular, to a guidance system for a beam rider projectile. While the invention is discussed in particular detail with respect to its missile control application, those skilled in the art will recognize the wider applicability of the inventive concepts disclosed hereinafter. In particular, the invention relates to a method for providing an encoded beam pattern in which the apparent central axis of the beam along a target aim point is shifted to a second axis so that a receiver in the beam is provided with a lead angle component. The lead angle component preferably is based on target tracking rate, wherein the second axis is made to lead the target aim point.

This invention deals with improvements in guidance systems, and in particular, to a guidance system similar to that disclosed in the U.S. Pat. to Esker et al, U.S. Pat. No. 4,014,482, issued Mar. 29, 1977, with which the invention disclosed hereinafter finds application. Details of the guidance system and a missile employed with that system not specifically set forth herein are intended to be incorporated by reference to the Esker et al patent and to the U.S. Patent to Tucker, U.S. Pat. No. 3,868,883, issued Mar. 4, 1975, incorporated by reference in Esker et al, U.S. Pat. No. 4,014,482.

The guidance system disclosed in Esker et al, U.S. Pat. No. 4,014,482, includes a beam projector at a launch site, and a beam receiver and signal decoder carried by the missile. The beam projector employes a laser diode source, laser pulse driver circuits, beam encoder, optic means for projecting the encoded beam, and electronic circuits for controlling the optic means operation. The beam encoder utilizes a reticle having a plurality of spokes formed in it, an opto-interupter for sensing reticle center rotation rate, and drive motor control electronics. The reticle has a center mounted for rotation orbitally about the generated beam so that at least a portion of the reticle intersects the beam in all positions of the reticle. The laser diode source is pulsed at two different rates, those rates being coordinated with the angular position of the reticle center. The laser beam is encoded by rotating the center of the reticle about an axis of the optical system in conjunction with the variation of the pulse repetition rate of the laser source to produce a spatial modulation of the radiated beam. Since the speed of rotation of the reticle center remains constant in U.S. Pat. No. 4,014,482, the missile attempts to align itself with the projected beam axis, where the spatial frequency modulation is a minimum.

While the invention described in Esker et al works well for a stationary beam, the accuracy of the system has been found less than optimized when the beam platform or beam itself is moving and in certain other operating conditions. As indicated above, the guidance system of this invention is designed for use with a number of projectile types. Some launching and projectile types offer more disturbance or recoil to the operator of the projectile system during launch than others. This invention permits the operator greater accuracy by maintaining the beam axis stable during the disturbance, permitting the missile to fly the shifted beam axis rather than the operator's instaneous line of sight aim. Improvement in system accuracy is significant at relatively short operating ranges. Likewise, use of the system described in Esker et al with targets moving at relatively high rates of speed can result in target misses because the actual projectile position often lags behind the moving target line of sight and the collimated center of the projected beam.

The operational performance of the guidance system disclosed in Esker et al can be improved appreciably, particularly with respect to moving targets by providing lead angle information to the missile receiver. Lead angle information is obtained by varying the rate of orbital rotation of the reticle about the optical system axis. That is to say, during each revolution of the reticle center about the optical system axis, the rotational rate of the reticle center is increased and decreased cyclicly to provide lead angle information to a projectile in the beam. The basic technique consists of frequency modulating the rotational rate of the reticle. The frequency modulation amplitude is made to equal the magnitude of the desired angular change in the projected spatially coded axis, and the frequency modulation phase is made to equal the direction in which the spatially coded axis shift is desired. The effect that this beam information has on the missile borne receiver is such that the receiver interprets the image of the reticle pattern as if the receiver were displaced from its unmodulated position in a direction from beam center as indicated by the modulation phase. Since the missile control devices operate to direct the missile toward axis center, or minimum frequency modulation, the missile follows the coded axis shift.

In use, the invention gives stabilization to the coded axis when the beam and the beam projector platform are unstabilized, furnishes spatially coded axis lead angle with respect to the beam center to compensate a missile borne guidance control loop containing a position error when in a moving beam, and supplies a manual or an electronic bore sight alignment between the coded beam axis and a gunner's sight when small angular displacement errors exist.

One of the objects of this invention is to provide improved means for controlling the flight of a projectile.

Another object of this invention is to provide a line of sight guidance system with a lead angle component.

Another object of this invention is to provide a guidance system having improved accuracy for guiding a projectile towards the target.

Another object of this invention is to provide a line of sight guidance system which is relatively inexpensive, light weight, portable and which requires little or no special skill or training in its operation.

Another object of this invention is to provide a means for adjusting the orbital speed of rotation of the reticle center about an optical axis along which a beam is projected based on the rate of change of beam projector motion.

Another object of this invention is to provide a guidance system for a beam rider projectile compatible with a wide range of projectile types.

Other objects of this invention will be apparent to those skilled in the art in light of the following description and accompanying drawings.

SUMMARY OF THE INVENTION

In accordance with this invention, generally stated, a guidance system for a beam rider projectile is provided with a control axis along which the projectile aligns itself, the direction and magnitude of the control axis angle between or with respect to the beam axis center being determined by projected beam axis movement rate and projectile range. The guidance system includes a beam projector at a launch site, and a beam receiver and signal decoder carried by an object to be guided, preferably a missile or similar projectile. The beam projector is adapted to generate a coded control beam along a central optic system axis and includes a reticle having a center mounted for orbital rotation with respect to the optical system axis. The speed of reticle orbital rotation is varied so that the receiver, positioned in the beam, receives a frequency modulation minimum beam information signal at a position displaced from the optic system axis. The missile, which is adapted to align itself with the projected beam spatial modulation center, follows the beam minimum spatial frequency modulation signal. Consequently, the projectile's commanded position is made to lead the moving target line of sight a distance equal to the projectile's position lag with resulting improved guidance system accuracy.

BRIEF DESCRIPTION OF THE DRAWINGS

In the drawings,

FIG. 5 is a diagrammatic view illustrating reticle center rotation for FM frequency modulation coding of the beam utilized in conjunction with the missile director of FIG. 2;

FIG. 6 is a diagrammatic representation of a cross section of the beam projected through the reticle of the missile director of FIG. 2;

FIG. 7*a* is a graph illustrating the laser output frequency of the missile director of FIG. 2;

FIG. 7*b* is a diagrammatic representation comparing the instantaneous reticle velocity in a cross section of the beam generated by the missile director of this invention at a point in the beam;

FIG. 7*c* is a graphic representation illustrating the pulse width of a signal received at a point in the beam, individual pulses of the pulse plurality shown being, in practice, a group of twenty kilohertz or twenty-eight kilohertz, thirty five nanoseconds pulses, the particular frequency being determined by the position of the reticle center;

FIG. 7*d* is a graphic representation illustrating the frequency modulation amplitude and phase of a signal received at a point P in the beam; and FIG. 8 is a diagrammatic representation useful for explanation purposes in describing the spatial frequency modulation of the beam utilized with the missile director of this invention.

DESCRIPTION OF THE PREFERRED EMBODIMENT

Figure 1:
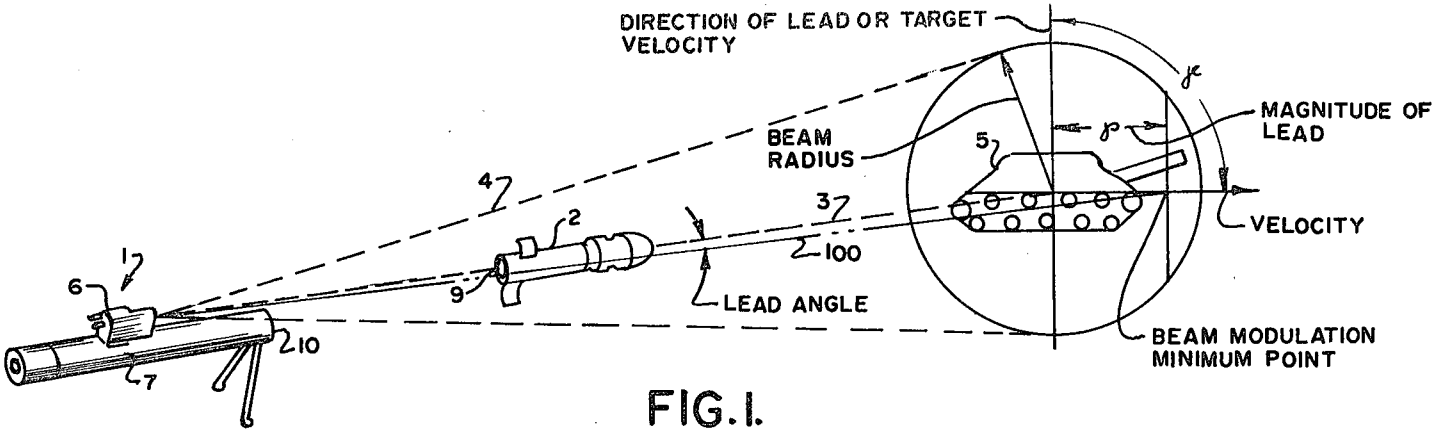
FIG. 1 is a view in perspective showing the relative in flight positions of a launch site and beam projector or missile director, a missile, a target and the lead angle induced in the control axis for the missile.

Referring now to FIG. 1, reference numeral 1 indicates a guidance system for directing a projectile, for example, a missile 2, along a centerline axis 3 of a beam 4, the beam 4 illuminating both the missile 2 and a target 5. The beam 4 is generated by a missile director 6 associated with a launch device 7.

The launch device 7 and missile 2 may comprise any variety of a suitable projectile and launcher vehicles. As indicated above, the missile and launcher described in the Tucker, U.S. Pat. No. 3,868,883, is particularly well adapted for use with this invention, provided the missile is modified as described in Esker et al, U.S. Pat. No. 4,014,482.

Figure 2:
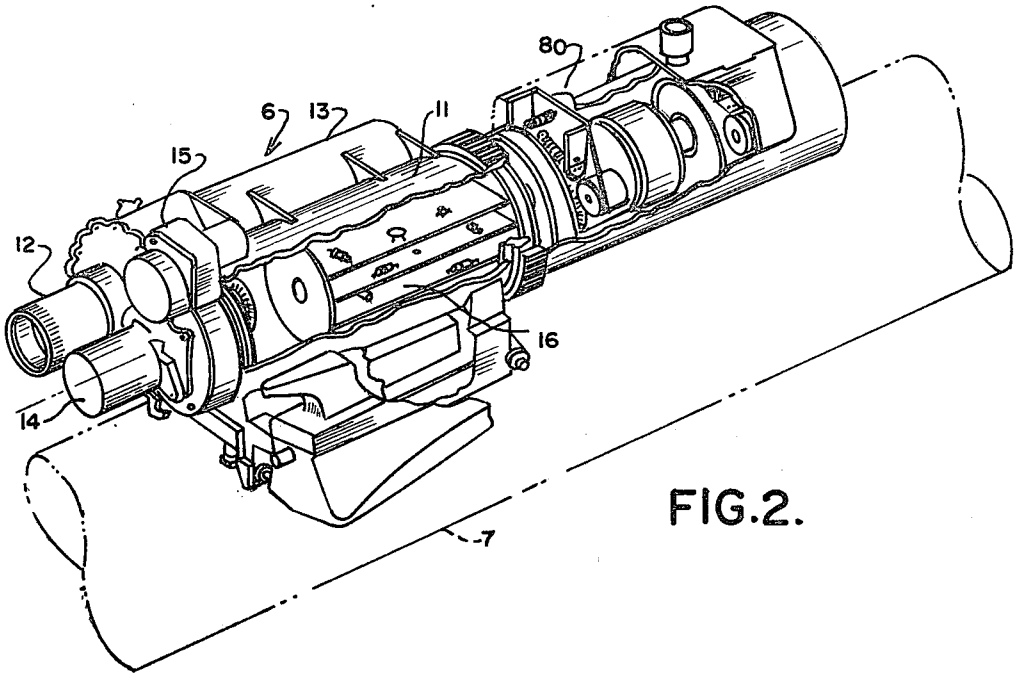
FIG. 2 is a view in perspective of one illustrative embodiment of missile director of this invention.

The launch device 7 includes a tube 10, preferably of a recoiless weapon type. The director 6 includes a housing 11 having a face guard (not shown), an eye piece 12, and a sighting scope 13 associated with it. Also contained within the housing 11 are a laser diode source of radiation 14 and its associated driver and control circuits, a beam encoder means 15 and its associated circuits, and a zoom lens optical system 80 and its associated drive circuits. The housing 11 is intended to be removably mounted to the launch device 7 by any convenient method. Launch device 7 conventionally is disposable, although in certain applications, the device may be utilized repeatedly. It may be observed, in FIG. 2, that the laser source 14 is aligned with the encoder 15 and the optical system 80. The beam projected by the director 6 physically passes through an electronic package area 16, which is arranged physically so that no interference with the beam occurs. Other embodiments of our invention may reposition the package area 16.

Figure 3:
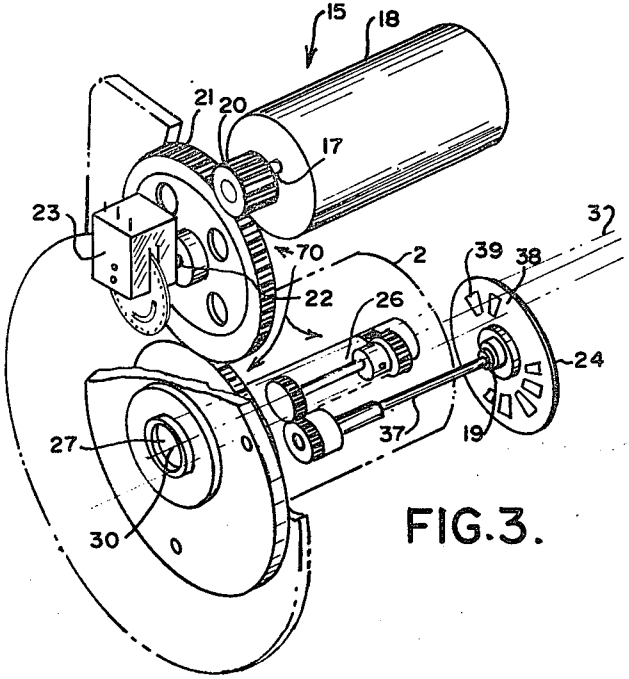
FIG. 3 is a view in perspective of an encoder assembly utilized in conjunction with the missile director of FIG. 2.

The beam encoder means 15 is shown with greater detail in FIG. 3. As there illustrated, a DC motor 18 has an output shaft 17 attached to a first gear 20 of a gear train 70. The encoder means 15 is substantially similar to that disclosed in Esker et al, U.S. Pat. No. 4,014,482, and details of the encoder means not described here may be found in that patent.

In general, the gear 20 of the gear train 70 is coupled to an encoder gear 21 by a conventional gear tooth arrangement, the gear teeth being diagrammatically shown in FIG. 3. The encoder gear 21 is mounted for rotation along a shaft 22. The shaft 22 also is mechanically coupled to an opto-interrupter means 23. The opto-interrupter means 23 generates a signal corresponding to the angular position of a center 19 of a reticle 24. A rotating motion for the reticle center 19 is produced by the gear train 70 and the center 19 of reticle 24 rotates about an axis offset from the centerline axis 3 of a bore 27 passing through a spindle 26. The bore 27 is sized to permit the laser beam radiation to pass through the spindle 26.

The reticle 24 is a flat disc with alternating opaque and transparent, equal size spokes 38 and 39, respectively. As indicated above, the center 19 of the reticle 24 is mounted so that it is offset from the axis 3 of the optical system. The beam generated by the director 6 will illuminate only a small circular section of the reticle 24 at any particular instant in the operation of the guidance system 1. The remainder of the optical system is used to radiate the laser source 14 energy so as to project an image of the illuminated portion of the reticle 24 into space along the axis 3 of the optical system. In order to encode usable information on the radiated beam, the reticle 24 is moved so as to interrupt the energy radiation at points within the radiated beam. As is known in the art, in particular the Esker et al U.S. Pat. No. 4,014,482, a section of the reticle, which represents the extremity of the projected beam is shown as a solid line circle in FIG. 5, and again in FIG. 6. The reticle 24 is shown in FIG. 5 with the alternating opaque and transparent spokes 38 and 39, respectively, drawn diagrammatically. The center 19 of reticle 24 follows the dash arrow path 40 during one rotational cycle. A point on the reticle 24 in FIG. 5 will move from the location shown at the bottom of the reticle 24 at a time $T_1$ to a location shown on the dash reticle 24 at a time $T_2$. At time $T_2$, the position of the reticle 24 in the beam will have spokes oriented as shown by the dash spoke outlines in FIG. 5. As is known in the art, frequency modulation coding of the beam occurs because of the shape of the spoke images and the instantaneous velocity of the spoke image across a detector aperture. In FIG. 6, one spoke of the reticle 24 is shown. If the instantaneous velocity of the center of the reticle 24 is straight down as indicated, for example, in FIG. 5, then the instantaneous velocity of all points on the spoke image also will be straight down with the same velocity magnitude. Consequently, a receiver 9 of the missile 2 in the beam, looking back at the encoder 15, will receive energy when a transparent spoke 39 of the reticle 24 passes through the beam, and will not receive energy when an opaque spoke 38 of the reticle 24 passes through the beam. For the reticle center position shown in FIG. 6 and when the receiver 9 is displaced horizontally toward the $V_3$ side of the beam center, as illustratively shown by a point P, the receiver will see a long signal on and long signal off periods, while a receiver 9 displaced toward the $V_1$ side of the beam will see short signal on and short signal off periods. A frequency discriminator, tuned to the frequency detected at the beam center, will produce a frequency modulated output signal with frequency deviation proportional to the displacement of the receiver 9 from the center of the beam. The rate of the reticle center rotation is shown in FIG. 5 to be equal to the reticle rotation rate to permit simplification of the operational explanation.

The description as set out above furnishes a frequency modulation proportional to the receiver 9 displacement from the optical axis. By sinusoidally accelerating the reticle center 19 orbit at the same frequency as the rotation rate, the centerline axis of the beam as defined by the minimum spatial modulation in the beam will shift to a new axis 100, shown in FIG. 1. Again referring to FIG. 6, if the speed of reticle center 19 rotation is varied, it will appear, to a receiver at the point P in the beam, that the receiver in fact has been repositioned either toward the $V_3$ or toward the $V_1$ part of the beam, depending upon the phase of the reticle center 19 orbit sinusoidal acceleration and the magnitude of the change in reticle center speed. This variation in reticle center rotation rate shifts the reference axis for the receiver 9 and provides the lead angle component to the guidance system.

FIGS. 7*a* through 7*d* illustratively show the beam coding/decoding operation. As explained in the Esker U.S. Pat. No. 4,014,482, the laser diode for generating the beam is electronically pulsed at different rates during the rotation of the reticle 24 center 19. As the reticle center 19 is rotated through the full rotational cycle, the image projected corresponds to that shown in FIG. 7*b*. A receiver and decoder carried by the missile 2 in the beam at the point P will see an error signal whose frequency deviation amplitude $\rho$ (rho), will be proportional to the displacement of point P from the apparent beam center, while the error signal phase $\beta$ (beta) will be proportional to the direction of the displacement error.

In the specific encoder means 15 utilized in the preferred embodiment of this invention, the reticle 24 also rotates about its center on a shaft 37, as best observed in FIG. 3. That is to say, both the center 19 of the reticle 24 and the reticle 24 itself are rotated during operation of the guided system 1 of this invention. As will be appreciated by those skilled in the art, reticle 24 rotation about its center and reticle center 19 rotation about the axis 3 need not occur at the same rate. Rotation of the reticle or the reticle center 19 about the axis 3 of the optical system, for the purposes of this specification, is denominated as movement orbital or orbitally. The terms orbital and orbitally are intended to encompass the variety of possible movements of the reticle center 19 rotation rate in addition to the sinusoidal rotation changes described. Rotating the reticle about its center and rotating the reticle center about the optical axis at different rates results in spatial modulation characteristics containing noise components, which result from mechanical and optical inaccuracies in the mechanisms comprising the encoder means 15, which can be shifted to frequencies outside the missile control range of frequencies processed by the decoder carried by the missile 2. In addition, the slope of the frequency deviation versus missile position in the beam can be increased to improve the resolution to the position error data.

FIG. 8 is a graphic representation which illustrates the encoding function of the missile director 6 and which defines the various parameters employed with the encoder means 15. Only a portion of the spokes of the reticle are shown for clarity in FIG. 8. The circular short dash line with the radius $\rho mx$ (rho)$_{mx}$ represents the portion of the reticle that is radiated by the source output, and also represents the reticle image projected in the beam. The long dash circle with the radius $r_o$ is the path followed by the reticle center about the optical axis. For convenience, a representative missile position point P, is shown displaced a distance $\rho$ from the center, with $\rho$ at an angle $\beta$ (beta) from a reference axis of the beam. The reticle center 19 rotates about the beam center or optical axis at rate $\omega_i$, and the reticle spokes rotate about the reticle center at a rate $\omega_r$. The instantaneous angular position of the reticle center is given by the equation $\theta = \omega_i t$. The modulation seen at the missile point P is related to the passage of the reticle spoke images, which is seen to be the difference between the rate of spoke rotation, $\omega_r$, and the rate of change of the angle $\theta_k$. The frequency is given by dividing this rate by the angle between adjacent leading edge reticle spokes $2\theta_c$, or:

$$f = \frac{1}{2\theta_c}\left[\omega_r - \frac{d\theta_k}{dt}\right]$$

An expression for $\theta_k$ can be derived using the law of sines:

$$\frac{\rho}{\sin\theta_k} = \frac{r_o}{\sin[180 - (\theta_k + \beta + \theta)]} = \frac{r_o}{\sin(\theta_k + \beta + \theta)}$$

which can be reduced to:

$$\theta_k = \arctan\frac{\rho\sin(\omega_i t + \beta)}{r_o + \rho\cos(\omega_i t + \beta)}$$

-continued $$\frac{d\theta_k}{dt} = \omega_i \frac{\rho}{r_o}\left[\frac{\frac{\rho}{r_o} + \cos(\omega_i t + \beta)}{1 + 2\frac{\rho}{r_o}\cos(\omega_i t + \beta) + (\frac{\rho}{r_o})^2}\right]$$

then:

$$f = \frac{\omega_r}{2\theta_c} - \frac{\omega_i}{2\theta_c}\frac{\rho}{r_o}\left[\frac{\frac{\rho}{r_o} + \cos(\omega_i t + \beta)}{1 + 2\frac{\rho}{r_o}\cos(\omega_i t + \beta) + (\frac{\rho}{r_o})^2}\right]$$

$$f_o = \frac{\omega_r}{2\theta_c} = \frac{N_B\,\omega_r}{2\pi}$$

which is the standard FM form $f = f_o + \Delta f$, with, where: NB is the number of spokes on the reticle and $\Delta f$ equals:

$$\Delta f = \frac{\omega_r \frac{\omega_i}{\omega_r} N_B}{2\pi}\frac{\rho}{r_o}\left[\frac{\frac{\rho}{r_o} + \cos(\omega_i t + \beta)}{1 + 2\frac{\rho}{r_o}\cos(\omega_i t + \beta) + (\frac{\rho}{r_o})^2}\right]$$

The demodulation process which takes place in the receiver/decoder uses a phase lock loop to extract the missile displacement, $\rho$, which appears as the modulation deviation and the missile displacement angle, $\beta$, which appears as the phase of the modulation referenced to the reticle image in the beam.

When the beam lead modulation is added to the encoder rotational rate, the resulting expression for the receiver frequencies can be set as follows:

$$f = \frac{N_B}{2\pi}(\omega_r - \frac{d\theta_k}{dt}) = \frac{N_B}{2\pi}\left[(\frac{\omega_r}{\omega_i})\,\omega_i - \frac{d\theta_k}{dt}\right]$$

The relationship between $\omega_r$ and $\omega_i$ is a constant and $\omega_i$ can be expressed as follows:

$$\omega_i = \omega_{io} + \frac{2}{\omega_{io}}\sin(\omega_{io}t + \gamma)$$

The phase position of the encoder rotor thus becomes:

$$\theta_i = \omega_{io}\,t - \frac{2}{\omega_{io}^2}\cos(\omega_{io}t + \gamma) + \beta$$

Then, by substitution, the previous equation for $\theta_k$ becomes:

$$\theta_k = \tan^{-1}\frac{\rho}{r_o}\,\frac{\sin[\omega_{io}t + \beta - \frac{2}{\omega_{io}^2}\cos(\omega_{io}t + \gamma)]}{1 + \frac{\rho}{r_o}\cos\{[\omega_{io}t + \beta - \frac{2}{\omega_{io}^2}\cos(\omega_{io}t + \gamma)] + \beta\}}$$

and $$\frac{d\theta_k}{dt} = [\omega_{io} + \frac{2}{\omega_{io}}\sin(\omega_{io}t + \gamma)]\frac{\rho}{r_o}\left[\frac{\frac{\rho}{r_o} + \cos[\omega_{io}t + \beta - \frac{2}{\omega_{io}^2}\cos(\omega_{io}t + \gamma)]}{1 + (\frac{\rho}{r_o})^2 + \frac{2\rho}{r_o}\cos[\omega_{io}t + 2\beta - \frac{2}{\omega_{io}^2}\cos(\omega_{io}t + \gamma)]}\right]$$

Then:

$$f = N_B f_i\left\{(\frac{\omega_r}{\omega_i})[1 + \frac{2}{\omega_{io}^2}\sin(\omega_{io}t + \gamma)] - [1 + \frac{2}{\omega_{io}^2}\sin(\omega_{io}t + \gamma)] \times \frac{\rho}{r_o}\left[\frac{\frac{\rho}{r_o} + \cos[\omega_{io}t + \beta - \frac{2}{\omega_{io}^2}\cos(\omega_{io}t + \gamma)]}{1 + (\frac{\rho}{r_o})^2 + \frac{2\rho}{r_o}\cos[\omega_{io}t + 2\beta - \frac{2}{\omega_{io}^2}\cos(\omega_{io}t + \gamma)]}\right]\right\}$$

This expression contains the reticle center acceleration magnitude, $2/\omega_{io}^2$, and phase, $\gamma$.

The synchronous detectors and the filters of the missile 2 remove all but the steady state component of this expression.

Figure 4:
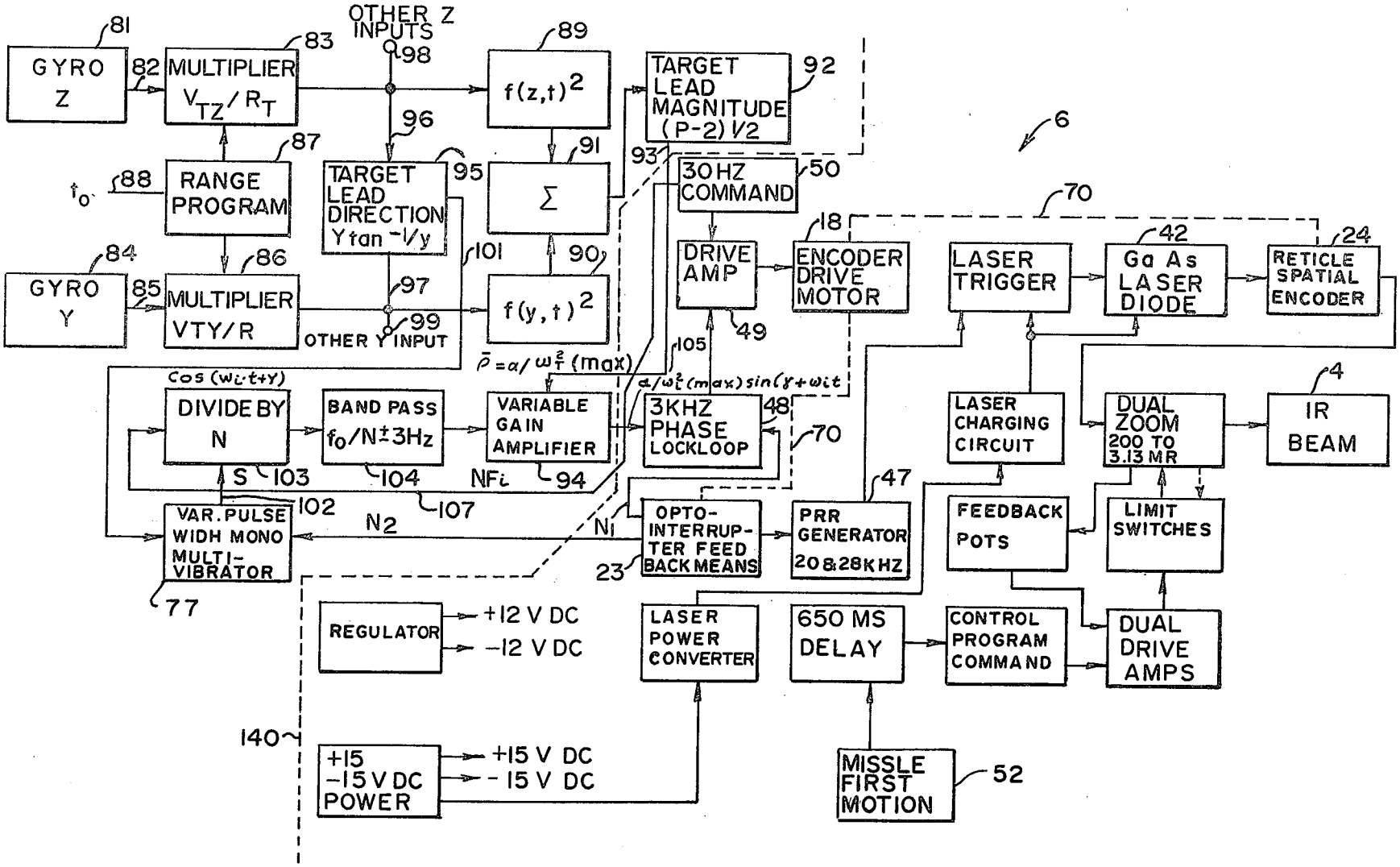
FIG. 4 is a block diagrammatic view illustrating the operation of the missile director shown in FIG. 2.

A functional block diagram of the missile director 6 is shown in FIG. 4. A dash line 140 separates the conventional components of the director 6, shown on the right side of the dash line 140, from those components added in order to provide beam lead capability and to control the speed of rotation of the reticle center, shown on the left side of the line 140. Information concerning the operation and purpose of the conventional portion of FIG. 4 is contained in the above disclosed U.S. Patent to Esker, U.S. Pat. No. 4,014,482. It is here noted that the source for the radiated beam 4 is a laser diode 42 and that a pulse repetition rate generator 47 is synchronized with the encoder reticle 24 and reticle center 19 movement so that it produces either of two predetermined pulse repetition rates during the rotation cycle of the reticle center 19 to provide the reticle image rotation reference signal modulation.

The opto-interrupter 23 provides an output signal which feeds both the pulse repetition rate generator 47, a phase lock loop 48, and a multivibrator 77. The output from the phase lock loop 48 forms an input to a motor drive means 49, the drive means 49 being operatively connected to the encoder drive motor 18. Means for generating a 30 hertz drive command input, generally indicated by the reference numeral 50, also is connected to the motor drive means 49. The drive means 49 powers the drive motor 18, which, as indicated above, is operatively connected to the reticle 24 through a gear train 70, shown in phantom lines in FIG. 4. The remaining components of the encoder 15 on the right side of the line 140 in FIG. 4, while important for encoder 15 operation, form no part of this invention and are not described in detail. Again, reference may be made to Esker, U.S. Pat. No. 4,014,482, for additional information. As indicated above, preferably the lead angle provided to the projected beam is a function of the slew or tracking movement rate of the director 6. Movement of the director is monitored by a pair of rate gyros 81 and 84 which generate signal representations of director movement about a Z axis and a Y axis respectively of a conventional Cartesian coordinate system. The Z and Y axes are perpendicular to the optical axis.

The Z axis rate gyro 81 has an output 82 forming an input to a multiplier 83. The Y axis rate gyro 84 has an output 85 forming an input to a multiplier 86. A range program means 87 generates a voltage function dependent upon time of launch of the projectile 2, the range program output function being initiated by a suitable start pulse at an input 88. The start pulse may be initiated, for example, by a missile first motion signal means 52. Output from the range program means 87 forms an input to the multipliers 83 and 86 respectively.

The respective outputs of the multipliers 83 and 86 form inputs to respective squaring means 89 and 90. The outputs of the squaring means 89 and 90 are combined at a summing means 91. The sum of the square output from the summing means 91 is an input to a square root means 92 which determines the magnitude of the tracking vector. That is to say, the square root means 92 provides the lead angle magnitude. An output 93 of the square root means 92 forms a first input to a variable gain amplifier 94, and controls the gain of that amplifier.

An arc tangent function generator 95 receives the Z and Y axes inputs from the rate gyros 81 and 84 and their multipliers 83 and 86 along inputs 96 and 97, respectively. The notation "other Z inputs" and "other Y inputs" indicated in FIG. 4 are shown for information purposes only, and may comprise bore sight corrections for the director 6. That is to say, it is possible to electrically compensate for various mechanical errors in the director 6 by electrical inputs to the arc target function generator 95. Such compensation, however, does not form a part of the invention disclosed herein.

An output 101 of the arc tangent generator 95 is a second input to the multivibrator 77 and provides the variable delay pulse width control. An output 102 of the multivibrator 77 forms an input to a divide by N counter 103 which controls the acceleration phase and thereby the direction of the lead angle. The counter 103 has an output forming an input to a band pass filter 104. The output of the band pass filter 104 is a second input to the variable gain amplifier 94. The variable gain amplifier 94 has an output 105 which forms an input to the phase lock loop 48.

Operation of the system shown in FIG. 4 is relatively simple to understand. As indicated, the basic speed control loop for the encoder drive motor 18 is controlled by the opto-interrupter 23, the phase lock loop 48, the motor drive means 49 and the encoder drive motor 18. An oscillator (not shown) in the phase lock loop 48 effectively matches the 30 hz command of the command means 50. Any difference in frequency develops an error voltage which drives encoder motor 18. The opto-interrupter 23 senses the change in speed and sends the new speed $N_1$ back to the phase lock loop 48 to increase or decrease the oscillator frequency. The acceleration control loop for reticle center 19 rotation is formed by providing a multiple of the 30 hz command 50 frequency along an output 107 to the counter 103. A multiple of one hundred is used in this embodiment. Counter 103 serves as a phase shifting network for the acceleration command 30 hz signal. The signal is filtered in band pass filter 104, adjusted in amplitude in amplifier 94 and used to modulate the oscillator in the phase lock loop 48. The motor speed of the drive motor 18 follows the error introduced due to the phase lock loop output differing from the 30 hz command. The counter 103 determines the start of the frequency acceleration modulation cycle and thereby determines the phase or direction of the coded axis shift. Control of the phase shift rests with the output of the arc tangent function generator 95, and the reticle center position reference signal, $N_2$ from the opto-interrupter 23, which provides the reference pulse start time for pulse width phase delay multivibrator 77.

The counter 103 is made to start its count by the time-out pulse output of the variable pulse-width multivibrator 77. As indicated, the start of the multivibrator pulse is established by the encoder rotor position obtained from the opto-interrupter feedback mechanism 23. The arc tangent function generator 95 output 101 is used to control the period of the monostable multivibrator 77. The counter 103 output is a square wave having a frequency at the reticle center mean rotational rate. The square wave is converted to a sign wave by the band pass filter 104.

The output of the band pass filter 104 is a constant amplitude voltage alternating at the speed of the reticle center mean rotation rate. This output is fed to the variable gain amplifier 94. The amplifier 94 gain is controlled by the magnitude of the Y and Z axes signals from the square root means 92. As indicated, that magnitude signal is the square root of the sum of squares of the magnitudes of the Y and Z axes body rates, angle errors and/or position controls obtained from the squaring means 89 and 90. The output of the variable gain amplifier 94 forms an input to the phase lock loop 48 to provide the speed variation for the encoder drive motor 18. The encoder drive motor 18 in turn varies the speed of the reticle center 19 rotation about the centerline axis of the beam at a cyclic rate equal to the reticle center rotational rate. The cyclic variation of the reticle center 19 speed has the same effect as making the missile 2 think its position in the beam has changed. The missile 2 consequently attempts to realign itself toward what the missile believes is beam center and thereby follows the coded axis shift. The operation of the remaining components of the guidance system is similar to that described in Esker U.S. Pat. No. 4,014,482.

It is thus apparent that the guidance system provided meets all the ends and objects as herein set forth above.

Numerous variations, within the scope of the appended claims, will be apparent to those skilled in the art in light of the foregoing description and accompanying drawings. Thus, the guidance system of this invention is compatible with a number of applications, in addition to the particular weapons system disclosed. Other applications include use of the techniques disclosed herein in infrared missile seekers which use pursuit guidance against aircraft type targets. The turning rate of the missile can be used effectively to advance the indicated target position so as to reduce the amount by which the missile is lagging the moving target. The design of the reticle may vary in other applications. While preferably the reticle center rotates about the optical axis, and the reticle rotates about its center, only the reticle center need be rotated. Various other forms of enclosures and reticle center drive means may be employed for the missile director 6, if desired. It will be understood that certain features and subcombinations of the invention are of utility and may be employed without reference to other features and subcombinations. Although various input and outputs were diagrammatically illustrated as single conductors, those skilled in the art will recognize that the use of a single conductor designation in a diagrammatic illustration merely facilitates the description of the system disclosed, and those single conductors may be multiple connectors in actual embodiments of this invention. With the information disclosed in the drawings and described hereinabove, those skilled in the art will be able to construct physical circuits from the block diagram shown. If additional circuit design information is desired, it may obtained, for example, from *Phase Lock Techniques,* Floyd M. Gardner, John Wiley & Sons, 1966; *Op Amps Replaced Transformer in Phase Detector Circuit,* Agaugi, Electronics, 1969; and *Characteristics and Applications of Modular Analog Multipliers,* E. Zuch, Electronics Instrumentation Digest, April, 1969. These variations are merely illustrative.

Having thus described the invention, what is claims and desired to be secured by Letters Patent is:

1. In a guidance system for providing guidance information to a missile for directing the missile toward a target, including means for projecting a binary coded beam of electromagnetic energy along an axis, reticle means mounted for rotation with respect to said beam so that all beam energy transmitted from said projecting means passes through said reticle, means for orbitally rotating said reticle about said beam axis, the improvement comprising means for cyclicly varying the speed of reticle orbital rotation based upon movement of said projecting means to advance the apparent beam center at said missile an amount proportional to the rate of movement of said projecting means.

2. The improvement of claim 1 wherein said means for cyclicly varying the speed of orbital reticle rotation includes first signal generating means for determining projector movement in a first direction, second signal generating means for determining projector movement in a second direction, means for determining the magnitude of projector movement based on the signals developed by said first and second signal generating means, means for determining the direction of projector movement based on said first and said second signal generating means, and amplifier means for modulating a control signal to the rotation means of said guidance system based upon the output of said amplifier means.

3. The improvement of claim 2 wherein said amplifier means is a variable gain amplifier.

4. The movement of claim 3 wherein said first and said second signal generating means comprise rate gyros.

5. A method for providing lead angle information to a beam projection guidance system, comprising:

generating a beam of electromagnetic energy;

projecting said beam through space toward a target;

following said target with said projected beam at the beam projector;

mounting a reticle so that it interrupts the projected beam;

rotating the reticle center orbitally about the projected beam axis; and adjusting the magnitude and phase of a cyclic change in speed of the orbital reticle center rotation based on the movement required to follow said target with said projector.

6. The method of claim 5 including the further step of rotating the reticle about its center, the speed of reticle rotation about its center being different from the speed of orbital reticle center rotation about the beam axis.

7. The method of claim 6 including the further step of pulsing the generated beam at a first frequency for at least one portion of each revolution of said orbital reticle rotation and at a second frequency for at least a second portion of each revolution of said orbital reticle rotation.

8. A guidance system for directing the manuevers of a guided device, comprising:

a source for producing a radiated beam;

means for projecting said beam along a first axis;

a reticle having a center positioned along a second axis, said reticle having a plurality of spokes extending outwardly from said reticle center;

mounting means for permitting orbital rotation of said reticle center about said first axis, at least a portion of said reticle intersecting said beam during rotation of said reticle center;

drive means for orbitally rotating said reticle center about said first axis; and means for cyclicly varying the speed of reticle orbital rotation about said first axis.

9. The device of claim 8 wherein said means for cyclicly varying the speed of reticle orbital rotation includes means for detecting movement of said projection means, and means responsive to said detecting means for advancing the apparent beam center at said missile an amount proportional to the rate of movement of said projecting means.

10. The device of claim 9 wherein said movement detecting means comprises first signal generating means for determining projection means movement in a first direction, and second signal generating means for determining projecting means moving in a second direction, said detecting responsive means comprising means for determining the magnitude of projection means movement based on the signals developed by said first and said second signal generating means, means for determining the direction of projection means movement based on said first and said second signal generating means, and amplifier means for modulating a control signal to the rotation means of said guidance device based upon the output of said amplifier means.

11. The device of claim 10 wherein said amplifier means is a variable gain amplifier.

12. The device of claim 11 wherein said first and said second generating means comprise rate gyros.

13. The device of claim 12 wherein said beam source is a laser diode.

14. A guidance device, comprising:

means for generating a laser beam;

means for projecting said laser beam along a first axis;

a reticle having a center, said reticle being mounted for rotation at a position offset with respect to said first axis and rotatable with respect to said first axis so that all projected beam energy passes through said reticle;

means for orbitally rotating said reticle about said first axis; and means for varying the speed of orbital rotation of said reticle.

15. In a guidance device for providing guidance information to a missile for directing the missile toward a target, including means for projecting a beam of electromagnetic energy along an axis, reticle means mounted for rotation with respect to said beam so that all beam energy transmitted from said projecting means passes through said reticle, means for rotating said reticle about said beam axis, the improvement which comprises means for varying the speed of reticle rotation about said beam axis to provide lead angle information in said projected beam.

* * * * *

UNITED STATES PATENT AND TRADEMARK OFFICE

CERTIFICATE OF CORRECTION

PATENT NO. : 4,243,187

DATED : January 6, 1981

INVENTOR(S) : Andrew T. Esker

It is certified that error appears in the above—identified patent and that said Letters Patent is hereby corrected as shown below:

Abstract of the Disclosure, lines 5 and 6 from bottom, "recticle" should read "reticle".

Column 6, line 28, "to the position" should read "of the position".

Column 11, line 49, "movement" should read "improvement".

Signed and Sealed this

*Twenty-ninth* Day of *September 1981*

[SEAL]

*Attest:*

GERALD J. MOSSINGHOFF

*Attesting Officer*

*Commissioner of Patents and Trademarks*